US011371212B2

(12) United States Patent
Tsuchie et al.

(10) Patent No.: US 11,371,212 B2
(45) Date of Patent: Jun. 28, 2022

(54) WORK MACHINE

(71) Applicant: Hitachi Construction Machinery Co., Ltd., Tokyo (JP)

(72) Inventors: Yoshiyuki Tsuchie, Matsudo (JP); Kouichi Shibata, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/418,412

(22) PCT Filed: Nov. 12, 2019

(86) PCT No.: PCT/JP2019/044344
§ 371 (c)(1),
(2) Date: Jun. 25, 2021

(87) PCT Pub. No.: WO2020/174768
PCT Pub. Date: Sep. 3, 2020

(65) Prior Publication Data

US 2022/0064904 A1 Mar. 3, 2022

(30) Foreign Application Priority Data

Feb. 26, 2019 (JP) ..... JP2019-033384

(51) Int. Cl.
*E02F 9/22* (2006.01)
*F15B 13/044* (2006.01)
(Continued)

(52) U.S. Cl.
CPC ..... *E02F 9/2228* (2013.01); *E02F 9/2267* (2013.01); *E02F 9/2285* (2013.01);
(Continued)

(58) Field of Classification Search
CPC ..... E02F 9/267; E02F 9/2228; E02F 9/2004; E02F 9/24; E02F 9/226; B25J 9/1664; G05B 2219/43168
See application file for complete search history.

(56) References Cited

U.S. PATENT DOCUMENTS 10,920,394 B2 * 2/2021 Kobayashi ..... E02F 9/2296
2010/0100274 A1 * 4/2010 Satake ..... F15B 20/008 701/31.4

(Continued)

FOREIGN PATENT DOCUMENTS

CN 10896665 A 12/2018
JP 2017-110672 A 6/2017

(Continued)

OTHER PUBLICATIONS

International Preliminary Report on Patentability (PCT/IB/338 & PCT/IB/373) issued in PCT Application No. PCT/JP2019/044344 dated Sep. 10, 2021, Including English translation of document C2 (Japanese-language Written Opinion (PCT/ISA/237), filed on Jun. 25, 2021) (five (5) pages).

(Continued)

*Primary Examiner* — Abiy Teka
(74) *Attorney, Agent, or Firm* — Crowell & Moring LLP

(57) ABSTRACT

In a work machine including a solenoid valve that generates a pilot pressure to drive a directional control valve with use of the delivery pressure of a pilot pump as a source pressure, a shut-off valve that shuts off a hydraulic operating fluid from the pilot pump to the solenoid valve, a first sensor that senses the amount of operation of an operation lever, and a second sensor that senses a state amount relating to operation of the solenoid valve, whether or not an abnormality of the second sensor exists is determined on the basis of a sensing signal of the second sensor. When it is determined that the second sensor is abnormal, on the basis of a sensing (Continued)

signal of the first sensor, an opening command is made to the shut-off valve if operation of the operation lever is sensed, and a closing command is made to the shut-off valve if the neutral state of the operation lever is sensed.

3 Claims, 7 Drawing Sheets

(51) Int. Cl.
*E02F 9/24* (2006.01)
*E02F 9/20* (2006.01)

(52) U.S. Cl.
CPC ..... *E02F 9/2292* (2013.01); *E02F 9/24* (2013.01); *F15B 13/044* (2013.01); *E02F 9/2004* (2013.01); *E02F 9/2271* (2013.01); *F15B 2013/0448* (2013.01)

(56) References Cited

U.S. PATENT DOCUMENTS

2017/0166253 A1* 6/2017 Kondo ..... E02F 9/2267
2018/0051444 A1 2/2018 Yamashita et al.
2018/0066416 A1* 3/2018 Hijikata ..... E02F 9/268
2018/0266082 A1* 9/2018 Tanishige ..... E02F 3/3677
2019/0345692 A1 11/2019 Saitoh et al.
2020/0173145 A1 6/2020 Ogawa et al.

FOREIGN PATENT DOCUMENTS

JP 6316776 B2 4/2018
JP 6324347 B2 5/2018
JP 2018-169015 A 11/2018

OTHER PUBLICATIONS

International Search Report (PCT/ISA/210) issued in PCT Application No. PCT/JP2019/044344 dated Jan. 21, 2020 with English translation (five (5) pages).
Japanese-language Written Opinion (PCT/ISA/237) issued in PCT Application No. PCT/JP2019/044344 dated Jan. 21, 2020 (three (3) pages).
Chinese-language Office Action issued in Chinese Application No. 201980088713.9 dated Apr. 1, 2022 (six (6) pages).

* cited by examiner

WORK MACHINE

TECHNICAL FIELD

The present invention relates to a work machine such as a hydraulic excavator.

BACKGROUND ART

There is a work machine in which a solenoid valve (spool control valve) is operated by an electrical operation lever and a primary pressure output from a pilot pump is reduced by the solenoid valve to generate a pilot pressure that drives a directional control valve to operate an actuator. In this kind of work machine, a work machine is known in which, in the case in which the pilot pressure is higher than a predetermined pressure when the operation lever is neutral, it is determined that the solenoid valve is in the state of being stuck in the open state (hereinafter, referred to as stuck-open) and the primary pressure is shut off by a shut-off valve to stop the actuator (patent document 1).

PRIOR ART DOCUMENT

Patent Document

Patent Document 1: JP-2017-110672-A

SUMMARY OF THE INVENTION

Problem to be Solved by the Invention

However, no consideration is made in patent document 1 about the case in which an abnormality has occurred in a sensor (for example, pressure sensor) used for sensing of stuck-open of the solenoid valve, for example. If a system is employed in which the shut-off valve is closed to make the actuator inoperable without exception when it is impossible to determine whether or not stuck-open of the solenoid valve has occurred, this results in impairment of availability under the situation in which actually the solenoid valve involves no abnormality and the actuator can be normally operated. Conversely, if a system in which the shut-off valve is opened without exception when it is impossible to determine stuck-open of the solenoid valve is employed, it becomes impossible to stop the actuator when stuck-open of the solenoid valve occurs although the actuator can be normally operated under the situation in which stuck-open of the solenoid valve has not occurred.

An object of the present invention is to provide a work machine that does not make an actuator inoperable beyond necessity but still can stop the actuator by lever operation when stuck-open of a solenoid valve for driving a directional control valve has occurred in the situation in which it is impossible to sense the stuck-open of the solenoid valve.

Means for Solving the Problem

In order to achieve the above-described object, the present invention provides a work machine including: a hydraulic pump that delivers a hydraulic operating fluid; an actuator driven by the hydraulic operating fluid delivered from the hydraulic pump; a directional control valve that controls the flow of the hydraulic operating fluid supplied to the actuator; a pilot pump of a fixed displacement type; a solenoid valve that generates a pilot pressure to drive the directional control valve with use of a delivery pressure of the pilot pump as a source pressure; a shut-off valve that shuts off the hydraulic operating fluid from the pilot pump to the solenoid valve; a first sensor that senses the amount of operation of an operation lever; a second sensor that senses a state amount relating to operation of the solenoid valve; and a controller that controls the solenoid valve and the shut-off valve on the basis of sensing signals of the first sensor and the second sensor. In the work machine, the controller is configured to determine whether or not an abnormality of the second sensor exists on the basis of the sensing signal of the second sensor and, when determining that the second sensor is abnormal, on the basis of the sensing signal of the first sensor, make an opening command to the shut-off valve if operation of the operation lever is sensed and make a closing command to the shut-off valve if a neutral state of the operation lever is sensed.

Advantages of the Invention

According to the present invention, in the situation in which it is impossible to sense stuck-open of the solenoid valve for driving the directional control valve, the actuator is not made inoperable beyond necessity but still the actuator can be stopped by lever operation when the stuck-open of the solenoid valve has occurred.

MODES FOR CARRYING OUT THE INVENTION

Embodiments of the present invention will be described below with reference to the drawings.

First Embodiment

—Work Machine—

The present invention is not limited to a hydraulic excavator and can be applied also to other kinds of work machine such as a crane. In the following, description will be made by taking, as an example, the case in which the present invention is applied to a hydraulic excavator.

Figure 1:
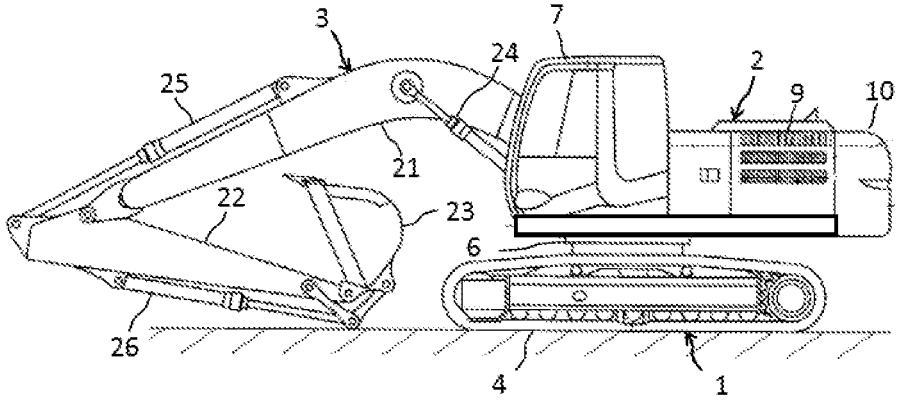
FIG. 1 is a left side view of a hydraulic excavator that is one example of a work machine according to a first embodiment of the present invention.

FIG. 1 is a left side view of a hydraulic excavator that is one example of the work machine according to the present invention. In the present embodiment, the left and the right in FIG. 1 are defined as the front and the rear of the work machine. The work machine illustrated in this diagram includes a track structure 1, a swing structure 2 disposed over the track structure 1, and a work implement (front work implement) 3 attached to the swing structure 2.

The track structure 1 is a base structural body of the work machine and is a crawler-type track structure that travels by left and right crawlers 4. However, a wheel-type track structure is used in some cases. The track structure 1 travels through driving of each of the left and right crawlers 4 by left and right traveling motors (not illustrated).

The swing structure 2 is disposed over the track structure 1 with the intervention of a swing circle 6 and has a cab 7 in which an operator rides at the front part of the left side. A swing motor (not illustrated) is attached to a swing frame that is a base frame of the swing structure 2. As the swing motor, an electric motor is used in some cases, and a hydraulic motor is used in other cases, and both are used in yet other cases. A power chamber 9 is disposed on the rear side of the cab 7 in the swing structure 2 and a counterweight 10 is disposed at the rearmost part. In the cab 7, an operation seat (not illustrated) on which the operator sits is disposed. Left and right operation levers (operation lever 16 in FIG. 2 and so forth) to make instructions of swing operation of the swing structure 2 and operation of the work implement 3 are disposed on the left and right of the operation seat. In the power chamber 9, a hydraulic pump 31 (see FIG. 2) that delivers a hydraulic operating fluid to drive a hydraulic actuator, a prime mover (not illustrated) that drives the hydraulic pump 31, a control valve device (for example, directional control valve 34 in FIG. 2) that controls the flow of the hydraulic operating fluid supplied to the hydraulic actuator, and so forth are housed. As the prime mover, an electric machine can be used besides an engine (internal combustion engine). In the swing structure 2, a controller 40 (see FIG. 2) that controls the respective operating devices including the prime mover is also included.

The work implement 3 is joined to the front part of the swing structure 2 (in the present embodiment, right side of the cab 7). The work implement 3 is an articulated front work device including a boom 21, an arm 22, and an attachment 23 (in the present embodiment, bucket). The boom 21 is directly joined to the swing frame pivotally in the upward-downward direction and is joined to the swing frame through a boom cylinder 24. The arm 22 is directly joined to the tip of the boom 21 pivotally and is joined to the boom 21 through an arm cylinder 25. The attachment 23 is directly joined to the tip of the arm 22 pivotally and is joined to the arm 22 through an attachment cylinder 26. The boom cylinder 24, the arm cylinder 25, and the attachment cylinder 26 are hydraulic actuators.

In the work machine of FIG. 1, the hydraulic operating fluid delivered from the hydraulic pump 31 is supplied to the swing motor (not illustrated), the boom cylinder 24, the arm cylinder 25, and the attachment cylinder 26 through the control valve device according to operation of the left and right operation levers. The swing structure 2 swings when the swing motor is driven. When the boom cylinder 24, the arm cylinder 25, and the attachment cylinder 26 are driven, the boom 21, the arm 22, and the attachment 23, respectively, are pivoted and the position and posture of the attachment 23 change. The track structure 1 is operated by a pedal-equipped lever (not illustrated) for traveling operation disposed on the front side of the operation seat.

—System Main Part—

Figure 2:
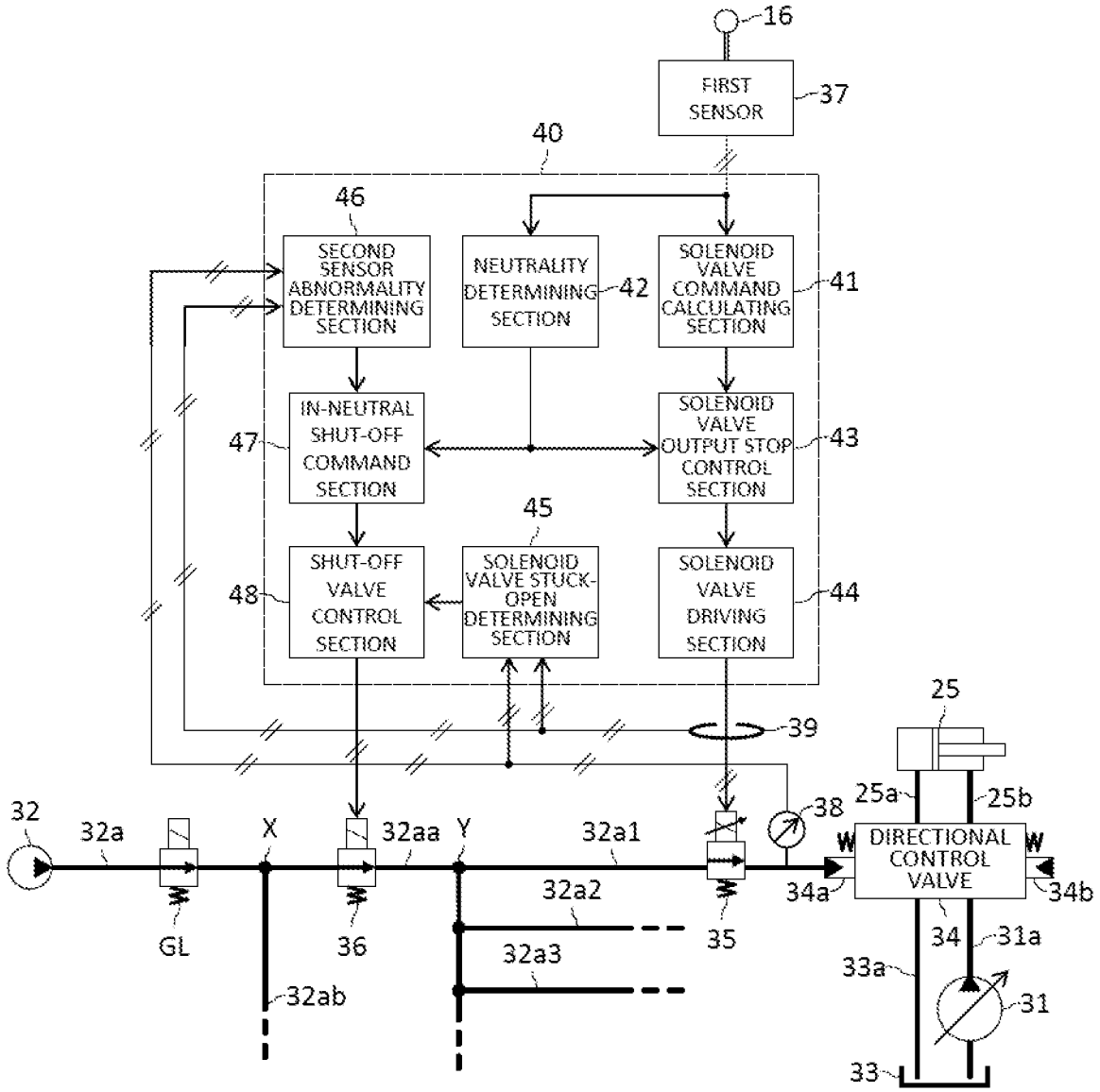
FIG. 2 is a diagram in which the main part of a drive system included in the work machine of FIG. 1 is partly extracted and represented.

FIG. 2 is a diagram in which the main part of a drive system included in the work machine of FIG. 1 is partly extracted and represented. In FIG. 2, functional blocks of the controller are represented together with a hydraulic circuit. Furthermore, in this diagram, a system relating to extension operation of the arm cylinder 25 is illustrated. The respective parts relating to contraction operation of the arm cylinder 25, extension/contraction operation of the boom cylinder 24 and the attachment cylinder 26, forward rotation/reverse rotation operation of the traveling motors also have a similar configuration. Thus, the part relating to the extension operation of the arm cylinder 25 will be described below as a representative and description of the parts relating to other operations is omitted.

The system of this diagram includes the hydraulic pump 31, a pilot pump 32, a hydraulic operating fluid tank 33, the directional control valve 34, a solenoid valve 35, a shut-off valve 36, a first sensor 37, and second sensors 38 and 39, and the controller 40.

Hydraulic Pump

The hydraulic pump 31 is a pump that delivers the hydraulic operating fluid to drive the arm cylinder 25 and so forth and is driven by the prime mover (not illustrated). Although the hydraulic pump 31 is the fixed flow rate type in some cases, the variable flow rate type is employed in the present embodiment. The hydraulic operating fluid delivered from the hydraulic pump 31 flows in a pump line 31*a* (delivery line of the hydraulic pump 31) and goes through the directional control valve 34 to be supplied to the arm cylinder 25. The return fluid from the arm cylinder 25 flows into a tank line 33*a* through the directional control valve 34 and is returned to the hydraulic operating fluid tank 33. On the pump line 31*a*, a relief valve (not illustrated) that restricts the highest pressure of this pump line 31*a* is disposed.

Pilot Pump

The pilot pump 32 is a pump of the fixed displacement type that outputs a primary pressure (source pressure) of a pilot pressure to drive a control valve such as the directional control valve 34 and is driven by the prime mover (not illustrated) as with the hydraulic pump 31. It is also possible to employ a configuration in which the pilot pump 32 is driven by a source of power different from the prime mover (not illustrated). A pilot line 32*a* is a delivery line of the pilot pump 32 and is connected to a pressure receiving part 34*a* on the arm crowding operation side in the directional control valve 34 through the solenoid valve 35.

Directional Control Valve

The directional control valve 34 is a hydraulic driven control valve that controls the flow (both the direction and the flow rate or only the direction) of the hydraulic operating fluid supplied from the hydraulic pump 31 to the arm cylinder 25 and is driven by the pilot pressure input to the pressure receiving parts 34*a* and 34*b*. To the respective ports of the directional control valve 34, a hydraulic line 25*a* that is connected to a bottom-side port of the arm cylinder 25 and a hydraulic line 25*b* that is connected to a rod-side port of the arm cylinder 25 are connected besides the pump line 31*a* and the tank line 33*a*. Furthermore, the pilot line 32*a* is connected to the pressure receiving part 34*a* on the arm crowding operation side in the directional control valve 34 through the solenoid valve 35 as described above. Here, the pilot line 32*a* branches into plural groups. As one example, suppose that the pilot line 32*a* branches into pilot lines 32*aa* and 32*ab* at a branch part X and the pilot lines 32*aa* and 32*ab* each branch into plural pilot lines, for example. In this case, plural pilot lines 32*a*1, 32*a*2, 32*a*3 . . . that branch off from the pilot line 32*aa* at a branch part Y are treated as one group. Similarly, plural pilot lines (not illustrated) that branch off from the pilot line 32*ab* are treated as one group. As one example, suppose that the group of the pilot line 32*aa* is connected to the corresponding pressure receiving parts of the respective directional control valves that drive the hydraulic actuators (boom cylinder 24, arm cylinder 25, and attachment cylinder 26) mounted on the work implement 3 and the swing motor. For example, the pilot line 32*a*1 is connected to the above-described pressure receiving part 34*a* and the pilot line 32*a*2 is connected to the pressure receiving part 34*b* on the arm dumping operation side in the directional control valve 34. The pilot line 32*a*3 is also connected to the corresponding pressure receiving part of the directional control valve (not illustrated) of the corresponding hydraulic actuator (for example, boom cylinder 24). As one example, suppose that the group of the pilot line 32*ab* branches and is connected to the corresponding pressure receiving parts of the respective directional control valves that drive the traveling motors.

In FIG. 2, when the pilot pressure acts on the pressure receiving part 34*a* (or 34*b*) of the directional control valve 34, a spool of the directional control valve 34 is moved to the right side (or left side) in FIG. 2. When the input of the pilot pressure stops, the spool reverts to the neutral position by a force of a spring. Although diagrammatic representation is simplified, the neutral position of the directional control valve 34 connects the pump line 31*a* to the tank line 33*a* and stops supply and discharge of the hydraulic operating fluid to and from the arm cylinder 25 to stop the extension/contraction operation of the arm cylinder 25. For example, when the pilot pressure acts on the pressure receiving part 34*a* of the directional control valve 34, the spool of the directional control valve 34 is moved to the right side by a distance according to the magnitude of the pilot pressure and the hydraulic operating fluid with a flow rate according to the pilot pressure is supplied to the bottom-side port of the arm cylinder 25 through the hydraulic line 25*a*. Due to this, the arm cylinder 25 extends at a speed according to the magnitude of the pilot pressure and the arm 22 is pivoted in the crowding direction. Conversely, when the pilot pressure acts on the pressure receiving part 34*b* of the directional control valve 34, the spool is moved to the left side and the hydraulic operating fluid is supplied to the rod-side port of the arm cylinder 25 through the hydraulic line 25*b*, thus the arm 22 is pivoted in the dumping direction. The other directional control valves (not illustrated) are also operated similarly to drive the corresponding hydraulic actuators.

Solenoid Valve

The solenoid valve 35 is, for example, a proportional solenoid-driven pressure reducing valve (spool control valve) of the normally-closed type disposed on the pilot line 32*a*1. The solenoid valve 35 is opened when the solenoid is excited by a command signal from the controller 40, and uses the delivery pressure of the pilot pump 32 as the source pressure (primary pressure) according to the magnitude of the command signal and reduces the delivery pressure to generate the pilot pressure to drive the directional control valve 34. The solenoid valve 35 has such a structure as to interrupt the connection between the pilot line 32*a*1 and the pressure receiving part 34*a* and connect the pilot line 32*a*1 to the hydraulic operating fluid tank 33 when being shut off and increase the ratio of the opening area of an outlet port leading to the pressure receiving part 34*a*, according to rise in the degree of opening. Although diagrammatic representation is omitted, similar solenoid valves are disposed also on the respective pilot lines (pilot line 32*a*2 and so forth) that branch off from the pilot line 32*a* and are connected to the corresponding pressure receiving parts.

Shut-off Valve

The shut-off valve 36 is a solenoid-driven selector valve (on-off valve) of the normally-open type that interrupts the connection between the pilot pump 32 and the solenoid valve 35. This shut-off valve 36 is disposed between the solenoid valve 35 and the pilot pump 32 on the pilot line 32*a* (in the present example, between the branch parts X and Y on the pilot line 32*aa*). The shut-off valve 36 has such a structure as to interrupt the connection between the pilot lines 32*a* and 32*aa* and connect the pilot line 32*a* to the hydraulic operating fluid tank 33 when being shut off and connect the pilot lines 32*a* and 32*aa* and interrupt the connection between the pilot line 32*a* and the hydraulic operating fluid tank 33 when being opened.

The shut-off valve 36 is what is separate from a so-called gate lock valve GL. The gate lock valve GL is disposed on the upstream side relative to the branch part X of the respective pilot lines that is led, through branching off, to the respective pressure receiving parts of the respective directional control valves including the directional control valve 34. When the gate lock valve GL is closed, all directional control valves are set to the neutral position irrespective of whether or not operation is carried out, and all hydraulic actuators stop. In contrast, the shut-off valve 36 is located on the downstream side relative to the branch part X, and is disposed so as to shut off the pilot pressure that drives the directional control valves of one group (for example, the hydraulic actuators of the work implement 3 and the swing motor) when all directional control valves are divided into plural groups. However, it is also possible to employ a configuration in which the shut-off valve 36 is disposed on each of the respective pilot lines that connect to the individual pressure receiving parts (for example, on the downstream side relative to the branch part Y).

When the solenoid is excited by a signal from the controller 40, the shut-off valve 36 is switched to the shut-off position and, in the present embodiment, shuts off the primary pressure for the solenoid valves (solenoid valve 35 and so forth) that belong to the group of the pilot line 32*aa*. When the solenoid is demagnetized, the shut-off valve 36 reverts to the communication position and causes the primary pressure to act on the solenoid valves that belong to the group of the pilot line 32*aa*. However, when the normally-closed type is employed as the shut-off valve 36, the timings of the excitation and the demagnetization are interchanged.

First Sensor

The first sensor 37 senses the amount of operation of the operation lever 16 (in the present embodiment, the amount of arm crowding operation). The first sensor 37 is, for example, an angle sensor such as a potentiometer incorporated in an electrical lever device and senses the tilt of the operation lever 16 to output the tilt to the controller 40 as the amount of operation. The electrical lever device including the operation lever 16 is disposed on either one side of the left and right of the operation seat inside the cab 7.

Second Sensor

The second sensors 38 and 39 are sensors that sense a state amount relating to operation of the solenoid valve 35. The second sensor 38 is, for example, a pressure sensor and is disposed at a position between the pressure receiving part 34*a* of the directional control valve 34 and the solenoid valve 35 on the pilot line 32*a*1. The magnitude of the pilot pressure that is generated by the solenoid valve 35 and is applied to the directional control valve 34 is measured by the second sensor 38 and is input to the controller 40. Furthermore, the second sensor 39 is, for example, an ammeter and is disposed on an electrical signal line that connects the controller 40 to the solenoid of the solenoid valve 35. The magnitude of an electrical signal (current) that is generated by the controller 40 and is applied to the solenoid valve 35 is measured by the second sensor 39 and is input to the controller 40. In the present embodiment, the magnitude of the pilot pressure and the electrical signal sensed by these second sensors 38 and 39 corresponds to the state amount relating to the control state of the solenoid valve 35.

Controller

The controller 40 is an in-machine computer that controls the solenoid valve 35 and the shut-off valve 36 on the basis of sensing signals of the first sensor 37 and the second sensors 38 and 39 and has a CPU and a memory, for example. This controller 40 includes a solenoid valve command calculating section 41, a neutrality determining section 42, a solenoid valve output stop control section 43, a solenoid valve driving section 44, a solenoid valve stuck-open determining section 45, a second sensor abnormality determining section 46, an in-neutral shut-off command section 47, and a shut-off valve control section 48. The elements of the controller 40, such as the solenoid valve command calculating section 41, the neutrality determining section 42, . . . , are what arise from representing functions as constituent elements and are implemented or configured by a single or plural CPUs.

The solenoid valve command calculating section 41 calculates a command value proportional to the amount of operation (in the present example, the amount of arm crowding operation) of the operation lever 16 on the basis of a signal of the first sensor 37 and outputs the command value to the solenoid valve output stop control section 43.

Figure 5:
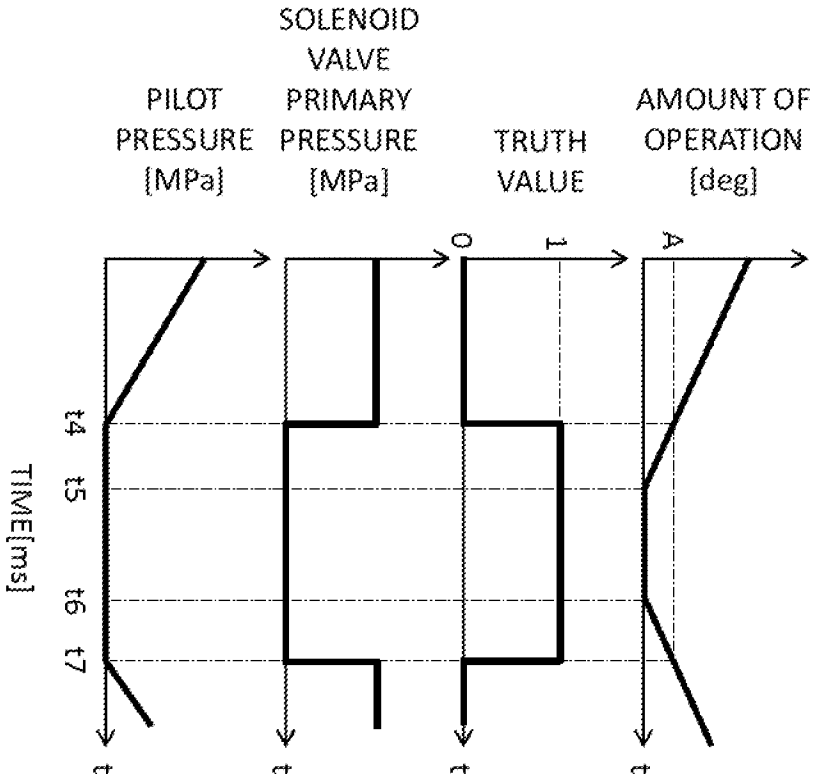
FIG. 5 is a diagram that represents the relation among lever operation, a solenoid valve primary pressure, and the pilot pressure when the solenoid valve is normally operated under the situation in which it is impossible to determine stuck-open of the solenoid valve in the first embodiment.

The neutrality determining section 42 determines whether the operation lever 16 is in the neutral position on the basis of the amount of operation of the operation lever 16 calculated from the signal of the first sensor 37 and outputs the determination result to the solenoid valve output stop control section 43 and the in-neutral shut-off command section 47. That the position of the operation lever 16 is the neutral position is equivalent to that the operation lever 16 is not being operated. In the neutrality determining section 42, for example, when the amount [deg] of operation of the operation lever 16 is smaller than a set value A, it is determined that the position of the operation lever 16 is the neutral position, and 1 that represents that the operation lever 16 is in the neutral position is output as the truth value (FIG. 5). Conversely, when the amount of operation of the operation lever 16 is equal to or larger than the set value A, it is determined that the operation lever 16 is being operated beyond the neutral position, and 0 that represents that the operation lever 16 is not in the neutral position is output as the truth value (FIG. 5). Although not particularly illustrated in the diagram, the operation lever 16 is pressed toward the neutral position by a spring and naturally reverts to the neutral position in the state in which a hand is released from the operation lever 16, for example.

The solenoid valve output stop control section 43 outputs the command value calculated by the solenoid valve command calculating section 41 to the solenoid valve driving section 44 when the determination result input from the neutrality determining section 42 is what notifies that the position of the operation lever 16 is not the neutral position (that is, the operation lever 16 is being operated). Conversely, when the determination result input from the neutrality determining section 42 is what notifies that the position of the operation lever 16 is the neutral position (that is, the operation lever 16 is not being operated), the solenoid valve output stop control section 43 outputs the command value to stop the solenoid valve 35 to the solenoid valve driving section 44.

The solenoid valve driving section 44 generates an electrical signal (for example, current) according to the command value input from the solenoid valve output stop control section 43 and outputs the electrical signal to the solenoid of the solenoid valve 35. When the operation lever 16 is operated, the electrical signal with magnitude according to the amount of operation is applied to the solenoid and the solenoid valve 35 is opened, thus the pilot pressure generated by the solenoid valve 35 according to the amount of lever operation with use of the delivery pressure of the pilot pump 32 as the source pressure acts on the pressure receiving part 34*a* of the directional control valve 34. Conversely, when the operation lever 16 is in the neutral position (is not being operated), the solenoid is demagnetized and the solenoid valve 35 is closed. Even when the operation lever 16 is in the neutral position, a minute current (standby current) is output from the solenoid valve driving section 44. The purpose thereof is to enhance the responsiveness of the solenoid valve 35 by vibrating a movable iron core of the solenoid of the solenoid valve 35 by the minute current and making a standby state in which not a static friction force but a dynamic friction force acts on a sliding part of the movable iron core.

Figure 3:
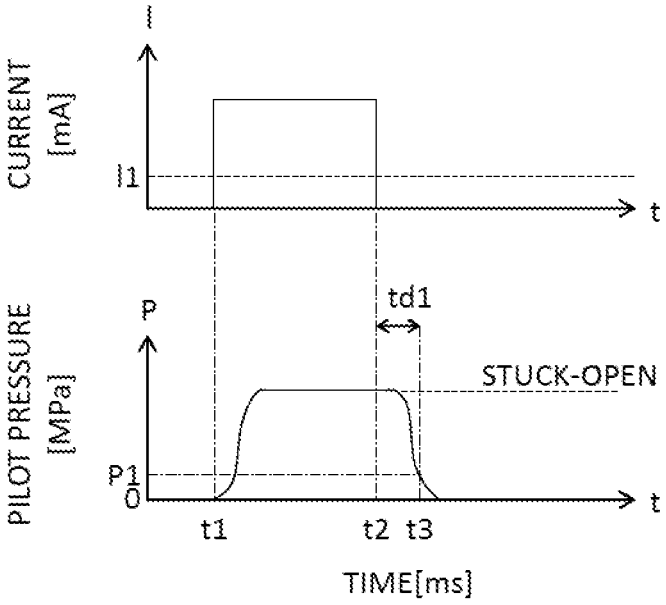
FIG. 3 is a diagram that represents the relation between a pilot pressure generated by a solenoid valve illustrated in FIG. 2 and a current applied to the solenoid valve.

The solenoid valve stuck-open determining section 45 compares the electrical signal (current) that drives the solenoid valve 35 and the pilot pressure generated by the solenoid valve 35 on the basis of signals of the second sensors 38 and 39, and determines whether or not stuck-open of the solenoid valve 35 has occurred and outputs the determination result to the shut-off valve control section 48. The contents of determination processing of stuck-open will be described as follows by using FIG. 3 representing the relation between the pilot pressure generated by the solenoid valve 35 and the current applied to the solenoid valve. When lever operation is carried out at a clock time t1, the solenoid valve 35 is opened by the electrical signal (current I [mA]) from the controller 40 and the pilot pressure P [MPa] rises up. When the operation lever 16 is returned to the neutral position at a clock time t2, the solenoid valve 35 is closed and the pilot pressure P decreases to 0. Due to the existence of operation delay of the solenoid valve 35, the pilot pressure P increases or decreases with delay by a response delay time td1 [ms] with respect to increase or decrease in the current I. Thus, it is determined whether the pilot pressure P is equal to or lower than a set value P1 [MPa] at the timing (in this diagram, clock time t3) after the response delay time td1 has elapsed from when the current I applied to the solenoid of the solenoid valve 35 has fallen below a set value I1 [mA] (in this diagram, from the clock time t2). When the pilot pressure P is equal to or lower than the set value P1 at the clock time t3 as shown by a solid line in this diagram, it is determined that stuck-open has not occurred in the solenoid valve 35 in the solenoid valve stuck-open determining section 45. Conversely, when the pilot pressure P does not lower although the lever operation is stopped and the pilot pressure P is higher than the set value P1 at the clock time t3 as shown by a dashed line in this diagram, it is determined that stuck-open has occurred in the solenoid valve 35 in the solenoid valve stuck-open determining section 45.

The second sensor abnormality determining section 46 determines whether or not an abnormality of the second sensors 38 and 39 themselves exists on the basis of the sensing signals of the second sensors 38 and 39. The second sensor 38, which is the pressure sensor, incorporates a strain gauge and a normal output voltage range is defined as the specification in order to sense abnormalities such as disconnection and short-circuiting. In the present embodiment, assuming that the normal output voltage range of the second sensor 38 is 0.5 to 4.5 V, for example, it is determined that the second sensor 38 is abnormal in the second sensor abnormality determining section 46 when the output is lower than 0.5 V or higher than 4.5 V. Regarding the second sensor 39, which is the ammeter, an abnormality is determined on the basis of the output current specification of the controller 40 (solenoid valve driving section 44). Specifically, when the sensed value of the second sensor 39 is smaller than the minimum output current (standby current) of the solenoid valve driving section 44, it is determined that the second sensor 39 is abnormal in the second sensor abnormality determining section 46. Furthermore, also when the sensed value of the second sensor 39 is equal to or larger than the maximum output current of the solenoid valve driving section 44, it is determined that the second sensor 39 is abnormal in the second sensor abnormality determining section 46. It is determined that the second sensor 39 is normal when the sensed value of the second sensor 39 falls within, for example, the range from the minimum output current of the solenoid valve driving section 44 to the maximum output current thereof.

The in-neutral shut-off command section 47, when the second sensor abnormality determining section 46 has determined that at least one of the second sensors 38 and 39 is abnormal, and when the neutral state of the operation lever 16 is sensed by the neutrality determining section 42, generates a command to make a closing command to the shut-off valve 36 and outputs the command to the shut-off valve control section 48. Furthermore, the in-neutral shut-off command section 47, even when the second sensor abnormality determining section 46 has determined that at least one of the second sensors 38 and 39 is abnormal, and when operation of the operation lever 16 is sensed by the neutrality determining section 42, generates a command to make an opening command to the shut-off valve 36 and outputs the command to the shut-off valve control section 48. Note that, the in-neutral shut-off command section 47, when the second sensor abnormality determining section 46 has determined that both of the second sensors 38 and 39 are normal, generates a command to make an opening command to the shut-off valve 36 irrespective of the determination result of the neutrality determining section 42 and outputs the command to the shut-off valve control section 48.

The shut-off valve control section 48 outputs an electrical signal (current) to make a closing command to the solenoid of the shut-off valve 36 when the determination result that stuck-open has occurred in the solenoid valve 35 is input from the solenoid valve stuck-open determining section 45 and when the closing command of the shut-off valve 36 is input from the in-neutral shut-off command section 47. Due to this, the shut-off valve 36 is closed and the connection between the solenoid valve 35 and the pilot pump 32 is interrupted. When stuck-open of the solenoid valve 35 is not sensed by the solenoid valve stuck-open determining section 45 and the closing command of the shut-off valve 36 is not made by the in-neutral shut-off command section 47, the shut-off valve control section 48 demagnetizes the solenoid of the shut-off valve 36 to connect the pilot pump 32 with the solenoid valve 35.

Control Procedure of Shut-off Valve

Figure 4:
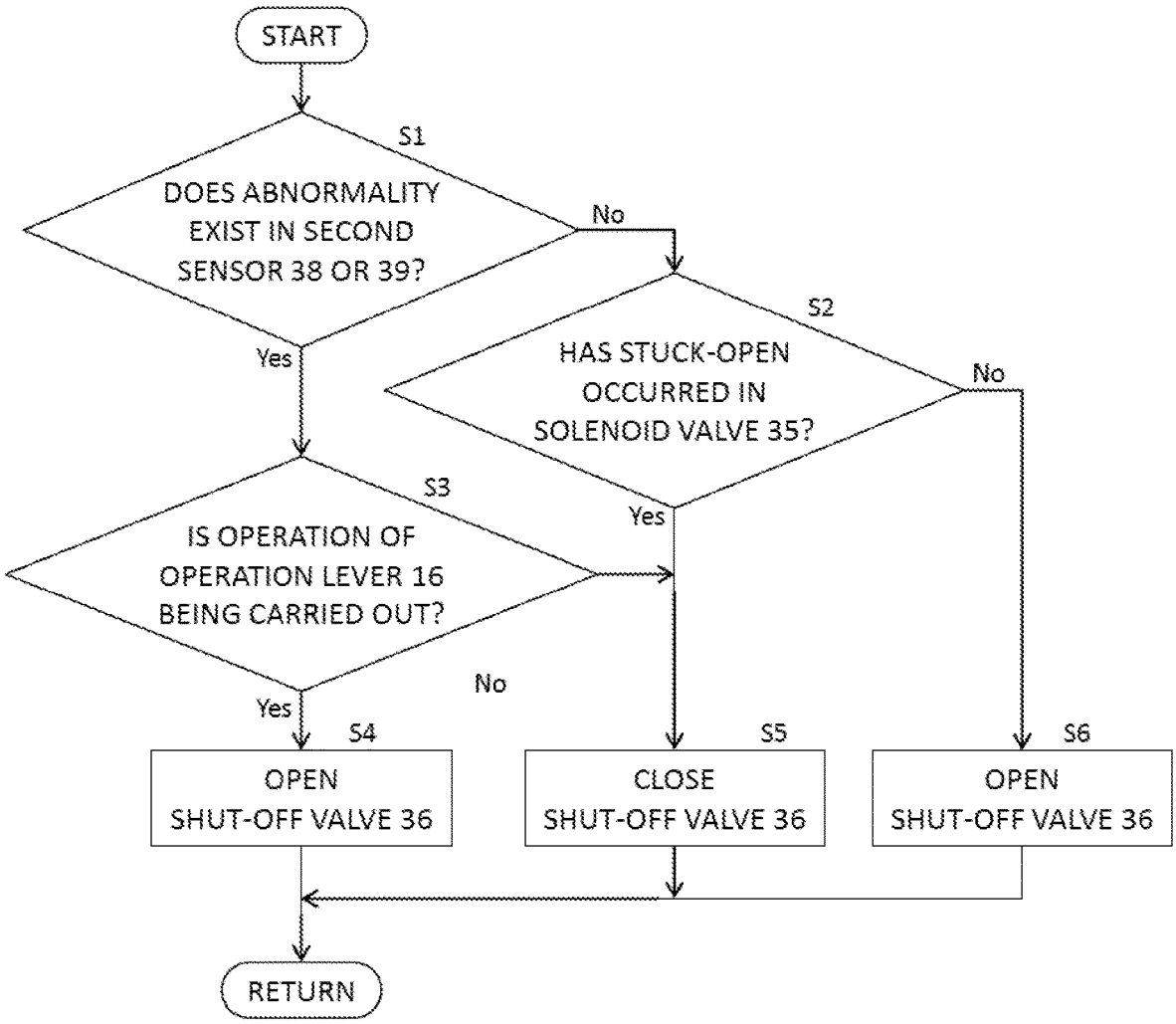
FIG. 4 is a flowchart that represents the control procedure of opening/closing control of a shut-off valve by a controller illustrated in FIG. 2.

FIG. 4 is a flowchart that represents the control procedure of opening/closing control of the shut-off valve 36 by the controller 40. The series of processing illustrated in this diagram is repeatedly executed by the controller 40 with a predetermined cycle time (for example, 0.1 s) while the prime mover operates and the controller 40 is powered on. When an operator starts the prime mover of the work machine by a key switch (not illustrated), the controller 40 loads a control program of the shut-off valve 36 from the memory into the CPU and activates the control program. Upon activating the control processing, first, signals of the first sensor 37 and the second sensors 38 and 39 are input to the controller 40 and the controller 40 determines whether an abnormality has occurred in the second sensor 38 or 39 by the second sensor abnormality determining section 46 (step S1). When the second sensors 38 and 39 are both normal, the controller 40 determines whether or not stuck-open has occurred in the solenoid valve 35 by the solenoid valve stuck-open determining section 45 on the basis of the signals of the second sensors 38 and 39 (step S2). When at least one of the second sensors 38 and 39 is abnormal, the controller 40 generates, by the in-neutral shut-off command section 47, the opening/closing command of the shut-off valve 36 according to whether or not operation of the operation lever 16 is being carried out on the basis of the determination result of the neutrality determining section 42 based on the signal of the first sensor (step S3).

The controller 40 controls opening and closing of the shut-off valve 36 by the shut-off valve control section 48 on the basis of the result of the determination by the second sensor abnormality determining section 46, the solenoid valve stuck-open determining section 45, and the in-neutral shut-off command section 47 in the steps S1 to S3.

Specifically, when it is determined that the second sensors 38 and 39 are both normal, if it is determined that stuck-open has occurred in the solenoid valve 35, the controller 40 outputs the closing command to the shut-off valve 36 by the shut-off valve control section 48 to close the shut-off valve 36 (step S5). Even when, similarly, it is determined that the second sensors 38 and 39 are both normal, if it is determined that stuck-open has not occurred in the solenoid valve 35, the controller 40 outputs the opening command to the shut-off valve 36 by the shut-off valve control section 48 to open the shut-off valve 36 (step S6).

On the other hand, when it is determined that at least one of the second sensors 38 and 39 is abnormal, if the neutral state of the operation lever 16 is sensed, the controller 40 outputs the closing command to the shut-off valve 36 by the shut-off valve control section 48 to close the shut-off valve 36 (step S5). Even when, similarly, it is determined that at least one of the second sensors 38 and 39 is abnormal, if operation of the operation lever 16 is sensed, the controller 40 outputs the opening command to the shut-off valve 36 by the shut-off valve control section 48 to open the shut-off valve 36 (step S4).

Upon executing the processing of any of the steps S4 to S6, the controller 40 returns the procedure to the step S1.

—Effects—

According to the present embodiment, in the situation in which it is impossible to determine whether or not stuck-open has occurred in the solenoid valve 35 due to an abnormality of the second sensor 38 or 39, the shut-off valve 36 is closed when the operation lever 16 is not being operated. However, even when it is impossible to determine stuck-open of the solenoid valve 35, the shut-off valve 36 is opened through operating the operation lever 16. Therefore, even when it is impossible to determine stuck-open of the solenoid valve 35, as illustrated in FIG. 5, the shut-off valve 36 is opened and the primary pressure is supplied to the solenoid valve 35 while the operation lever 16 is being operated (before a clock time t4 and after a clock time t7 in this diagram). In this case, the solenoid valve 35 is operated according to the lever operation when being not stuck. Thus, the pilot pressure is generated by the solenoid valve 35 and operation of the hydraulic actuator (in FIG. 2, arm cylinder 25) can be continued.

In the example of FIG. 5, the case is exemplified in which the amount of operation is lowered (operation lever 16 is returned to the neutral position) and the amount of operation becomes 0 at a clock time t5 and the amount of operation is raised from 0 (operation lever 16 is tilted) from a clock time t6. As mentioned above, in the neutrality determining section 42, it is determined that the position of the operation lever 16 is the neutral position when the amount [deg] of operation of the operation lever 16 is smaller than the set value A (in dead zone) as illustrated in this diagram. When it is determined that the position of the operation lever 16 is the neutral position, the truth value 1 that represents this is output (clock time t4 to t7). Conversely, when the amount of operation of the operation lever 16 is equal to or larger than the set value A, it is determined that the operation lever 16 is being operated beyond the neutral position, and the truth value 0 that represents that the operation lever 16 is not in the neutral position is output (before the clock time t4 and after the clock time t7).

Figure 6:
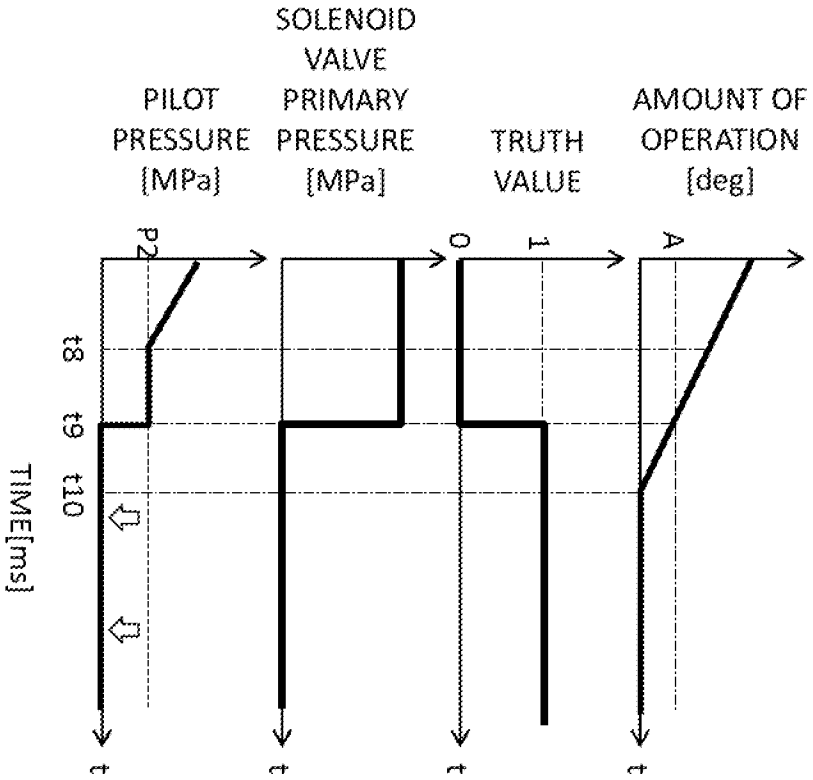
FIG. 6 is a diagram that represents the relation among the lever operation, the solenoid valve primary pressure, and the pilot pressure when stuck-open of the solenoid valve occurs under the situation in which it is impossible to determine stuck-open of the solenoid valve in the first embodiment.

On the other hand, a consideration will be made about, for example, the case in which, in FIG. 6, stuck-open occurs in the solenoid valve 35 due to biting of a foreign matter or the like at a clock time t8 in the process of returning the operation lever 16 to the neutral position (lowering the amount of operation and causing it to become 0 at a clock time t10). In this case, after the clock time t8, although the amount of operation decreases, the pilot pressure does not lower from a value P2 at the time of the occurrence of the stuck-open of the solenoid valve 35 as long as the shut-off valve 36 is opened (clock time t8 to t9). However, when the amount of operation lowers to the set value A and it is determined that the position of the operation lever 16 is the neutral position (clock time t9), the shut-off valve 36 is closed and the output of the primary pressure to the solenoid valve 35 stops, thus the output of the pilot pressure stops (after clock time t9). Therefore, even when stuck-open of the solenoid valve 35 occurs and action of the hydraulic actuator (in FIG. 2, arm cylinder 25) becomes unresponsive to operation, the hydraulic actuator can be surely stopped when the operation lever 16 is returned to the neutral position (for example, through only releasing a hand from the lever). The merit that the actuator can be surely stopped through lever neutrality without operating a separate emergency stop switch or the like is large.

As above, according to the present embodiment, in the situation in which it is impossible to sense stuck-open of the solenoid valve for driving the directional control valve, the hydraulic actuator is not made inoperable beyond necessity but still the actuator can be stopped by lever operation when the stuck-open of the solenoid valve has occurred.

Second Embodiment

Figure 7:
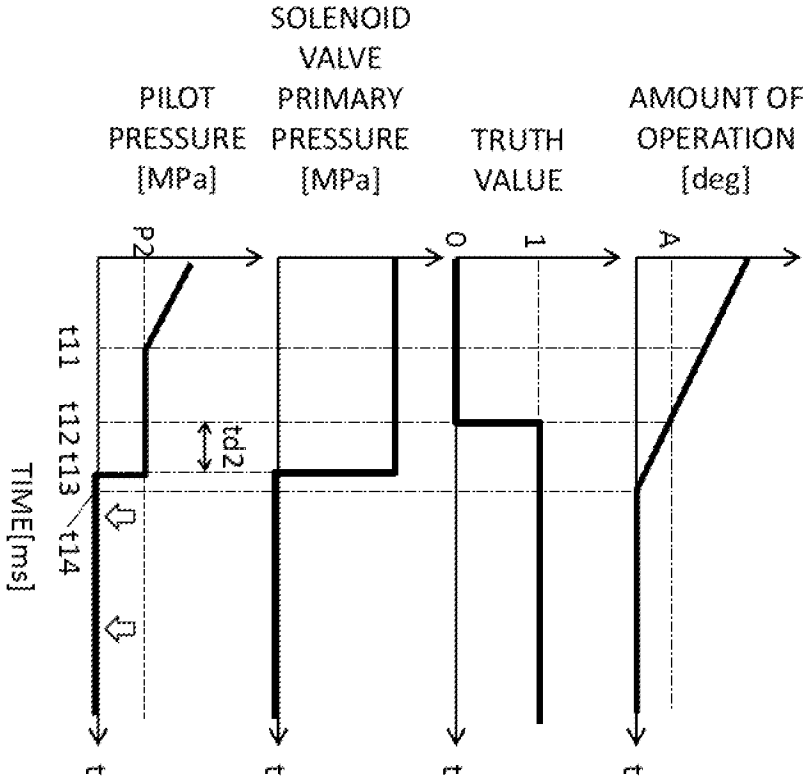
FIG. 7 is a diagram that represents the relation among the lever operation, the solenoid valve primary pressure, and the pilot pressure under the situation in which it is impossible to determine stuck-open of the solenoid valve in a second embodiment.

FIG. 7 is a diagram that represents the relation among lever operation, the solenoid valve primary pressure, and the pilot pressure under the situation in which it is impossible to determine stuck-open of the solenoid valve in a work machine according to a second embodiment of the present invention. In this diagram, the process of returning the operation lever 16 to the neutral position (lowering the amount of operation and causing it to become 0 at a clock time t14) is represented. The controller 40 in the present embodiment, when determining that at least one of the second sensors 38 and 39 is abnormal and sensing the neutral state of the operation lever 16, makes a closing command to the shut-off valve 36 after waiting for the elapse of a set time from the sensing of the neutral state of the operation lever 16. The present embodiment is the same as the first embodiment in both the operation and the configuration except that, as illustrated in FIG. 7, a delay time td2 (=t13−t12) from the timing at which the operation lever 16 becomes neutral (clock time t12) when the sensor is abnormal to the timing at which the shut-off valve 36 is closed (clock time t13) is set. In FIG. 7, the case in which stuck-open occurs in the solenoid valve 35 in lever operation (clock time t11) is exemplified corresponding to FIG. 6. However, also in the state in which stuck-open has not occurred, the shut-off valve 36 is closed at the timing at which the delay time td2 has been elapsed after the operation lever 16 is set to the neutral position when the sensor is abnormal. The delay time td2 is set to such a degree as to be equivalent to or slightly longer than the execution time of solenoid valve control (to be described later) in machine body stop control in the work machine, for example. As with the first embodiment, when the sensors are normal, the shut-off valve 36 is opened as long as stuck-open has not occurred in the solenoid valve 35.

In the present embodiment, the following effect is obtained in addition to effects of the first embodiment. In some cases, the work machine is equipped with a function of controlling a solenoid valve (equivalent to the solenoid valve 35) in such a manner as to limit the time change rate of the pilot pressure for the purpose of suppressing machine body vibrations in the machine body stop control. In this case, when control to close the shut-off valve on the condition that the lever is neutral when the sensor is abnormal is incorporated, the limit on the time change rate of the pilot pressure is precluded if the shut-off valve is immediately closed in association with reversion of the operation lever to the neutrality during execution of solenoid valve control. In contrast, in the present embodiment, interference with the solenoid valve control function at the time of the machine body stop control can be avoided by closing the shut-off valve 36 after waiting for the elapse of the delay time td2 after the reversion of the operation lever 16 to the neutral position as described above.

MODIFICATION EXAMPLES

In the above embodiments, description has been made by taking as an example the case in which both of the second sensors 38 and 39 are deemed as the target of abnormality sensing. However, a configuration in which either one is deemed as the target of abnormality sensing is also conceivable.

Furthermore, the configuration has been exemplified in which the shut-off valve 36 collectively shuts off the source pressure for the solenoid valves in units of group of the hydraulic actuators of the work implement 3, and so forth. In this case, it is possible to employ a configuration in which an abnormality of the second sensors is determined as described with FIG. 2 regarding the respective solenoid valves that belong to the same group and opening/closing control of the shut-off valve according to lever operation is carried out under the situation in which determination of stuck-open of any solenoid valve is impossible, for example.

Moreover, although the number of parts increases, a configuration is also conceivable in which the shut-off valve is disposed on each of pilot lines that are connected to the respective solenoid valves and, when determination of stuck-open relating to any solenoid valve becomes impossible, only the shut-off valve that corresponds to this solenoid valve in a one-to-one relation is deemed as the control target. In this case, the solenoid valve regarding which the connection to the pilot pump 32 is interrupted is suppressed to the minimum and the operability can be brought closer to the operability when an abnormality of the second sensor has not occurred. Conversely, although difference from the operability when an abnormality of the second sensor has not occurred possibly becomes large, for example, a configuration in which the gate lock valve GL (FIG. 2) is deemed as the control target as the shut-off valve is also conceivable. This is a merit in terms of reduction in the number of parts. In view of the balance between the number of parts and the operability, a configuration like the first embodiment or the second embodiment, in which the solenoid valves in units of group are deemed as the interruption target, is preferable.

DESCRIPTION OF REFERENCE CHARACTERS

16: Operation lever
25: Arm cylinder (actuator)
31: Hydraulic pump
32: Pilot pump
34: Directional control valve
35: Solenoid valve
36: Shut-off valve
37: First sensor
38, 39: Second sensor
40: Controller

The invention claimed is:

1. A work machine including a hydraulic pump that delivers a hydraulic operating fluid, an actuator driven by the hydraulic operating fluid delivered from the hydraulic pump, a directional control valve that controls flow of the hydraulic operating fluid supplied to the actuator, a pilot pump of a fixed displacement type, a solenoid valve that generates a pilot pressure to drive the directional control valve with use of a delivery pressure of the pilot pump as a source pressure, a shut-off valve that interrupts a connection between the pilot pump and the solenoid valve, a first sensor that senses an amount of operation of an operation lever, a second sensor that senses a state amount relating to operation of the solenoid valve, and a controller that controls the solenoid valve and the shut-off valve on a basis of sensing signals of the first sensor and the second sensor, wherein the controller is configured to determine whether or not an abnormality of the second sensor exists on a basis of the sensing signal of the second sensor, and when determining that the second sensor is abnormal, on a basis of the sensing signal of the first sensor, make an opening command to the shut-off valve if operation of the operation lever is sensed and make a closing command to the shut-off valve if a neutral state of the operation lever is sensed.

2. The work machine according to claim 1, wherein the controller is configured to determine whether stuck-open has occurred in the solenoid valve on a basis of the sensing signal of the second sensor when determining that the second sensor is normal, and make a closing command to the shut-off valve when determining that the stuck-open has occurred and make an opening command to the shut-off valve when determining that the stuck-open has not occurred.

3. The work machine according to claim 1, wherein the controller is configured to make a closing command to the shut-off valve after waiting for elapse of a set time from sensing of the neutral state of the operation lever when determining that the second sensor is abnormal and sensing the neutral state of the operation lever.

* * * * *